US005688182A

United States Patent [19]

Hill, Sr.

[11] Patent Number: 5,688,182

[45] Date of Patent: Nov. 18, 1997

[54] MULTIPLE COMPARTMENT TARGET PUTTING GAME

[76] Inventor: Phillip H. Hill, Sr., 19560 Afton Rd., Detroit, Mich. 48203

[21] Appl. No.: 725,288

[22] Filed: Oct. 2, 1996

[51] Int. Cl.[6] ..... A63B 69/36

[52] U.S. Cl. ..... 473/185

[58] Field of Search ..... 473/162, 185, 473/159, 181, 183, 184, 190, 189, 195

[56] References Cited

U.S. PATENT DOCUMENTS

| | | | |
|---|---|---|---|
| 1,712,561 | 5/1929 | Jaspert | 473/185 |
| 1,874,873 | 8/1932 | Boye | 473/185 |
| 1,952,187 | 3/1934 | Wade | 473/162 |
| 2,460,080 | 1/1949 | Gerding | 473/185 |
| 2,951,704 | 9/1960 | Neiler | 473/185 |
| 3,310,313 | 3/1967 | Colson | 473/185 |
| 3,722,889 | 3/1973 | Miller | 473/185 |
| 4,761,009 | 8/1988 | Gibree | 473/185 |

*Primary Examiner*—Mark S. Graham

[57] ABSTRACT

A game for practicing putting of a golf ball. The inventive device includes a flexible mat positionable upon a ground surface. A plurality of ball detents are directed into a front edge of the mat for supporting a plurality of golf balls. A target extends along a rear edge of the mat and includes a plurality of adjacent compartments into which a golf ball can be putted to obtain a predetermined number of points. A method of play of the game includes putting the balls into the target to obtain a predetermined score without exceeding the predetermined score.

1 Claim, 3 Drawing Sheets

10
12
14
14
16
18
18
20
22
22
2
2
3
4
4

MULTIPLE COMPARTMENT TARGET PUTTING GAME

BACKGROUND OF THE INVENTION

1. Field of the Invention

The present invention relates to golfing practice devices and more, particularly pertains to a multiple compartment target putting game for practicing putting of a golf ball.

2. Description of the Prior Art

The use of golfing practice devices is known in the prior art. More specifically, golfing practice devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art golfing practice devices include U.S. Pat. No. 5,316,302; U.S. Pat. No. 5,201,521; U.S. Pat. No. 5,016,884; U.S. Pat. No. 5,294,123; U.S. Design Pat. No. 347,661; and U.S. Design Pat. No. 243,777.

While these devices fulfill their respective, particular objectives and requirements, the aforementioned patents do not disclose a multiple compartment target putting game for practicing putting of a golf ball which includes a flexible mat positionable upon a ground surface, a plurality of ball detents directed into a front edge of mat for supporting a plurality of golf balls, and a target extending along a rear edge of the mat and including a plurality of adjacent compartments into which a golf ball can be putted to obtain a predetermined number points, wherein a method of play of the game includes putting the balls into the target to obtain a predetermined score without exceeding the predetermined score.

In these respects, the multiple compartment target putting game according to the present invention substantially departs from the conventional concepts and designs of the prior art, and in so doing provides an apparatus primarily developed for the purpose of practicing putting of a golf ball.

SUMMARY OF THE INVENTION

In view of the foregoing disadvantages inherent in the known types of golfing practice devices now present in the prior art, the present invention provides a new multiple compartment target putting game construction wherein the same can be utilized for practicing putting of a golf ball. As such, the general purpose of the present invention, which will be described subsequently in greater detail, is to provide a new multiple compartment target putting game apparatus and method which has many of the advantages of the golfing practice devices mentioned heretofore and many novel features that result in a multiple compartment target putting game which is not anticipated, rendered obvious, suggested, or even implied by any of the prior art golfing practice devices, either alone or in any combination thereof.

To attain this, the present invention generally comprises game for practicing putting of a golf ball. The inventive device includes a flexible mat positionable upon a ground surface. A plurality of ball detents are directed into a front edge of the mat for support a plurality of golf balls. A target extends along a rear edge of the mat and includes a plurality of adjacent compartments into which a golf ball can be putted to obtain a predetermined number of points. A method of play of the game includes putting the balls into the target to obtain a predetermined score without exceeding the predetermined score.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new multiple compartment target putting game apparatus and method which has many of the advantages of the golfing practice devices mentioned heretofore and many novel features that result in a multiple compartment target putting game which is not anticipated, rendered obvious, suggested, or even implied by any of the prior art tool guides, either alone or in any combination thereof.

It is another object of the present invention to provide a new multiple compartment target putting game which may be easily and efficiently manufactured and marketed.

It is a further object of the present invention to provide a new multiple compartment target putting game which is of a durable and reliable construction.

An even further object of the present invention is to provide a new multiple compartment target putting game which is susceptible of a low cost of manufacture with regard to both materials and labor, and which accordingly is then susceptible of low prices of sale to the consuming public, thereby making such multiple compartment target putting games economically available to the buying public.

Still yet another object of the present invention is to provide a new multiple compartment target putting game which provides in the apparatuses and methods of the prior art some of the advantages thereof, while simultaneously overcoming some of the disadvantages normally associated therewith.

Still another object of the present invention is to provide a new multiple compartment target putting game for practicing putting of a golf ball.

Yet another object of the present invention is to provide a new multiple compartment target putting game which includes a flexible mat positionable upon a ground surface, a plurality of ball detents directed into a front edge of mat for supporting a plurality of golf balls, and a target extending along a rear edge of the mat and including a plurality of adjacent compartments into which a golf ball can be putted to obtain a predetermined number points.

Even still another object of the present invention is to provide a new multiple compartment target putting game wherein a method of play of the game includes putting the balls into the target to obtain a predetermined score without exceeding the predetermined score.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
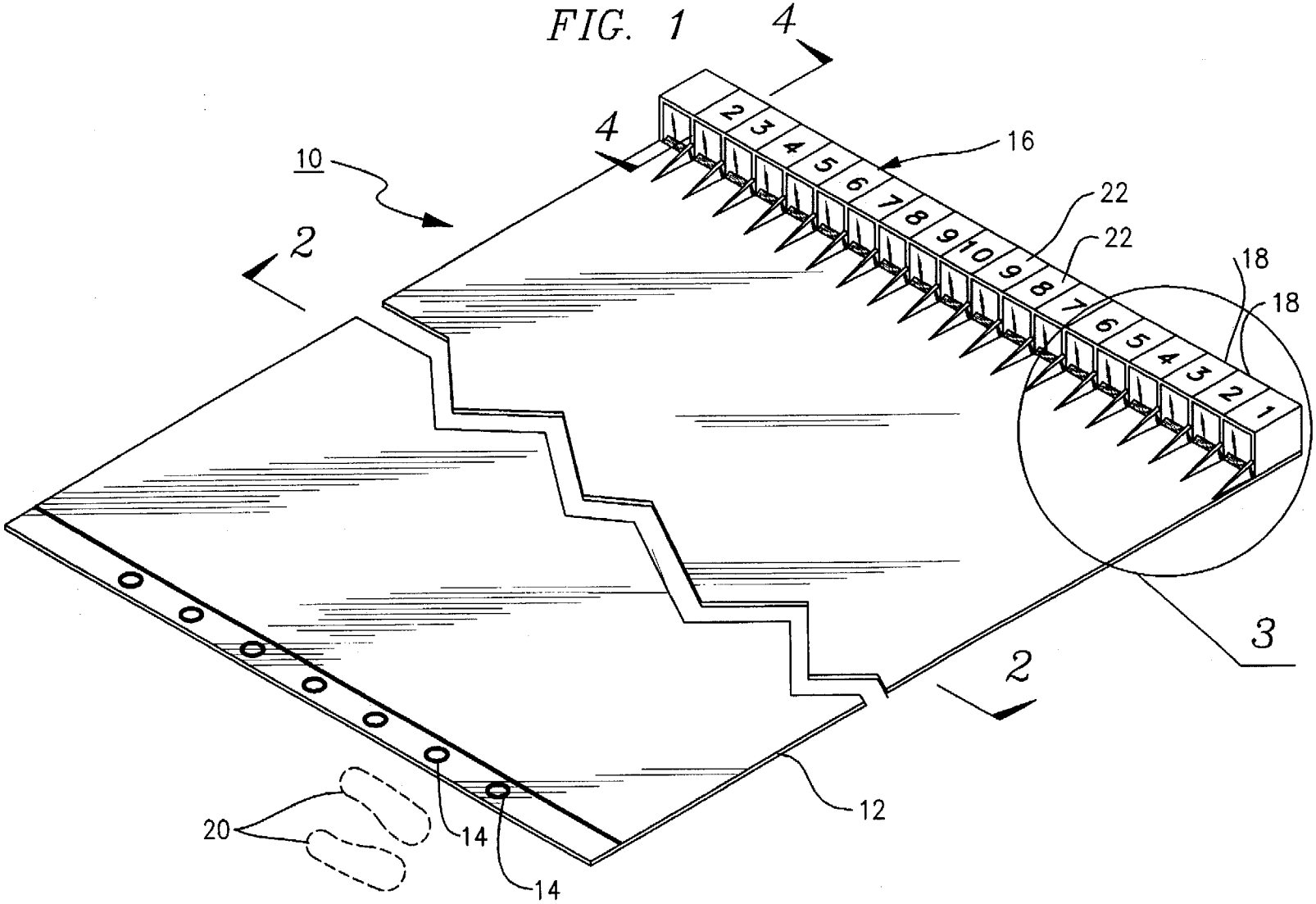
FIG. 1 is an isometric illustration of a multiple compartment target putting game according to the present.

With reference now to the drawings, and in particular to FIGS. 1–5 thereof, a new multiple compartment target putting game embodying the principles and concepts of the present invention and generally designated by the reference numeral 10 will be described.

More specifically, it will be noted that the multiple compartment target putting game 10 comprises an elongated flexible mat 12 positionable upon a support surface and preferably constructed so as to resemble putting green such as grass, carpet, or other conventionally known materials. The flexible mat 12 is shaped so as to define a plurality of ball detents 14 directed thereinto which each operates to support an individual one of a plurality of golf balls along a front edge of the flexible mat 12. A target 16 is mounted to a rear edge of the flexible mat 12 in a spaced relationship relative to the plurality of ball detents 14 and includes a plurality of adjacent compartments 18 which extend in a substantially parallel orientation relative to one another. By this structure, an individual standing in a position indicated by the foot prints 20 adjacent to the front edge of the flexible mat 12 can strike a golf ball residing within one of the ball detents 14 for attempted placement within one of the compartments 18 of the target 16. Each of the compartments 18 includes distinct colors or numerical indicia 22 printed thereon assigning a predetermined point value to each of the respective compartments. Thus, a game can be played with the present invention 10 wherein points are accrued in accordance with the particular compartment 18 into which a golf ball is positioned.

Figure 2:
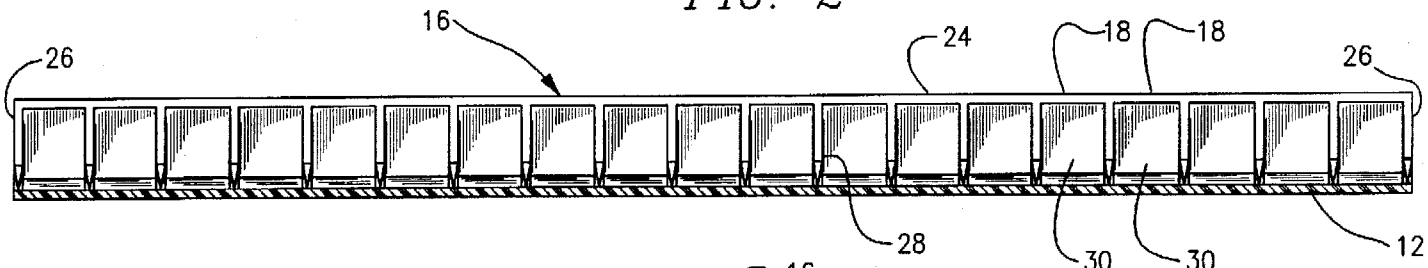
FIG. 2 is a cross sectional view taken along line 2—2 of FIG. 1.
Figure 3:
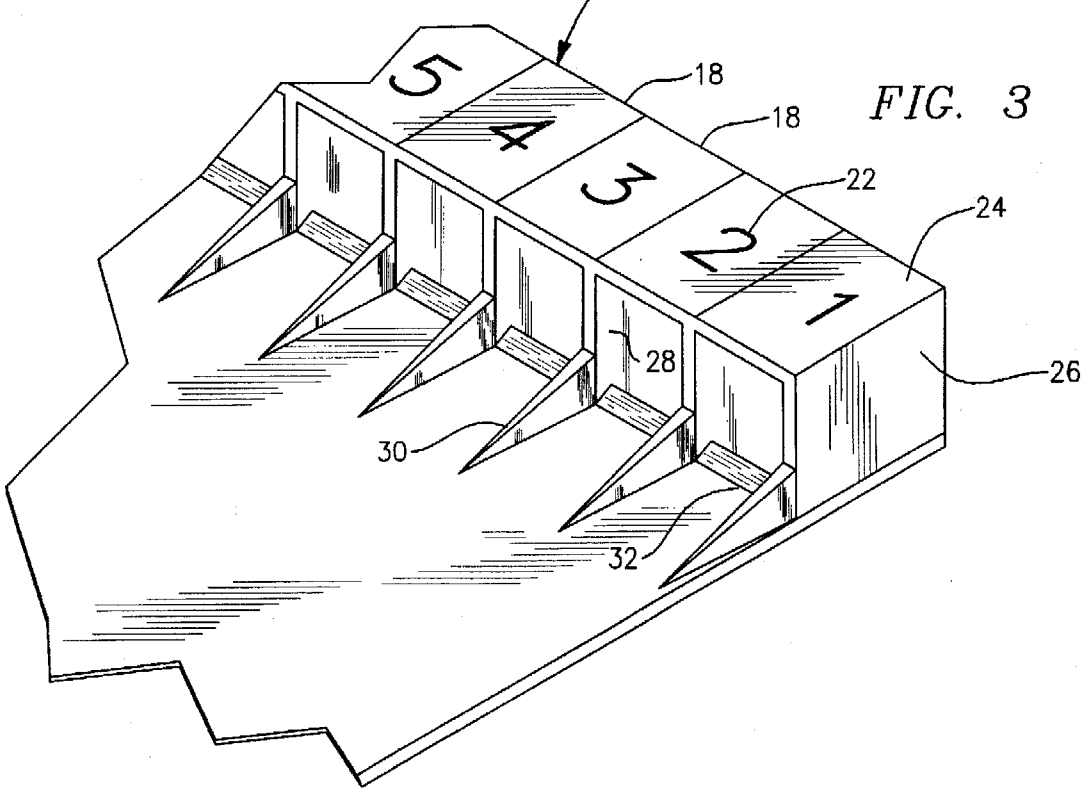
FIG. 3 is an enlarged isometric view of the area set forth in FIG. 1.

Referring now to FIGS. 2 through 5 wherein the present invention 10 is illustrated in detail, it can be shown that the target 16 of the present invention 10 preferably comprises an elongated top wall 24 extending in a substantially spaced and parallel orientation relative to the rear edge of the flexible mat 12. Spaced and parallel end walls 26 project substantially orthogonally between the flexible mat 12 and opposed transverse end edges of the top wall 24 so as to support the top wall in the spaced and parallel orientation relative to the flexible mat 12 as shown in FIG. 2 of the drawings. A plurality of dividing walls 28 extends substantially orthogonally between the flexible mat 12 and the top wall 24. The dividing walls 28 are spaced an equal distance apart and oriented so as to extend parallel to one another so as to define a plurality of compartments 18 of the target 16. Of course, the dividing walls 28 must be spaced a sufficient distance apart so as to accommodate a golf ball or other projectile therebetween. By this structure, any of the compartments 18 can operate to receive a golf ball being struck by an individual from one of the ball detents 14.

Figure 4:
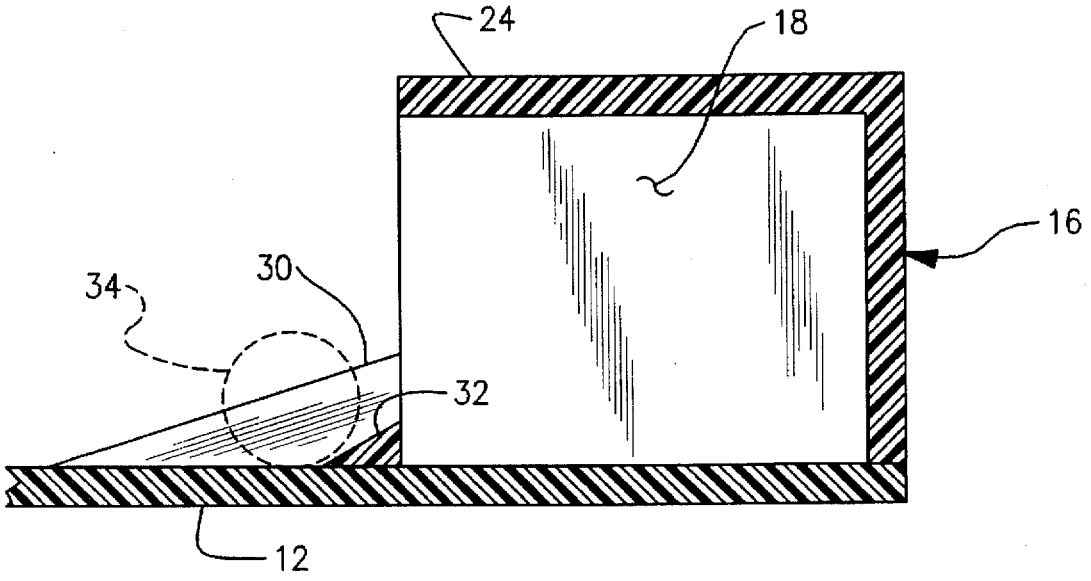
FIG. 4 is a cross sectional view taken along line 4—4 of FIG. 1.
Figure 5:
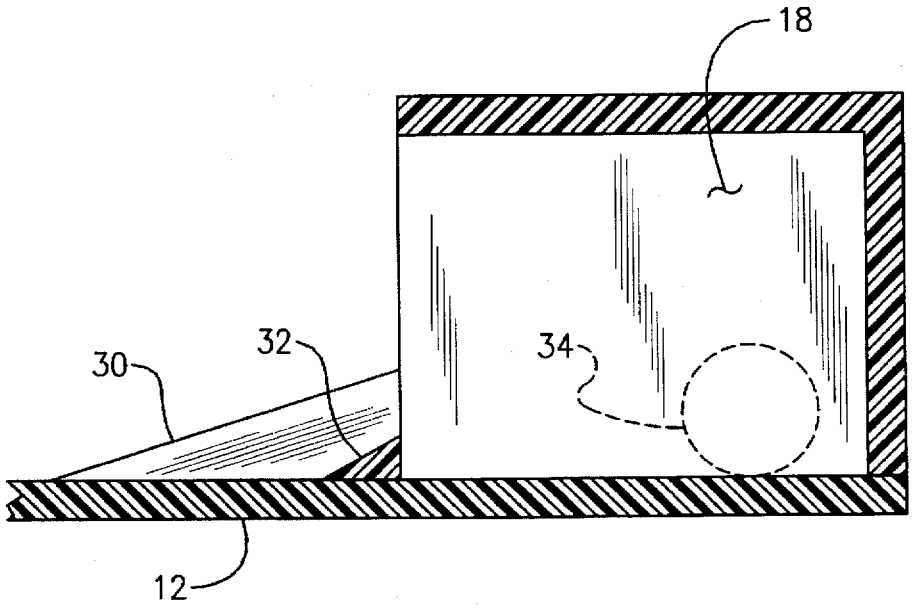
FIG. 5 is a further cross sectional view of the area shown in FIG. 4 illustrating an operation of a target of the invention.

To guide a golf ball into one of the compartments 18, it is desirable for the target 16 to further comprise a plurality of triangular guide plates 30 each projecting from an individual one of the dividing walls 28 and extending onto the elongated flexible mat 12 such that a pair of the triangular guide plates 30 reside on opposed sides of an individual one of the compartments 18. To effect retention of a golf ball within each respective compartment 18, as best illustrated in FIGS. 4 and 5, each of the compartments 18 includes a retention ramp 32 extending between the spaced guide plates 30 on opposed sides of the compartment. By this structure, a ball 34 traveling along the flexible mat 12, as shown in FIG. 4, will impact the retention ramp 32 and subsequently pass thereover into the particular compartment 18 for retention therein. Should the ball 34 be targeted directly towards one of the dividing walls 28, one of the triangular guide plates 30 will deflect the ball into an adjacent compartment 18.

A method of play of the present invention 10 comprises positioning a plurality of golf balls into the ball detents 14 along the front edge of the flexible mat 12. A predetermined winning score is selected and is preferably equal to thirty-six or seventy-two. Further, a predetermined number of balls is also selected, with a corresponding member of such balls being positioned into the ball detents 14. Preferably, seven balls are utilized during play of the game. Once a predetermined winning score has been decided upon by opposing players, a first player can stand in front of the forward edge of the flexible mat 12 as indicated by the foot prints 20 within FIG. 1 of the drawings and putt or otherwise strike a golf ball from one of the ball detents 14 for placement into one of the compartments 18 of the target 16 located at the rear edge of the flexible mat 12. The appropriate number of points as indicated by the numerical indica 22 printed above the respective compartments 18 into which the golf ball is positioned is then awarded to that player. The player then continues to putt golf balls from the ball detents 14 so as to obtain the predetermined score. It is important to note that the game is preferably played wherein the players must obtain the predetermined score without going over. In other words, if the predetermined score is thirty-six and a player exceeds the predetermined score, that particular player is declared a losing player and thus removed from the game.

In use, the multiple compartment target putting game 10 according to the present invention can be easily utilized to effect practicing of golf putting and/or playing of the associated game method as desired above. The flexible mat 12 is preferably of a length from approximately six to twelve feet long and can be positioned upon a flat or uneven ground surface as desired. Further, an individual may selectively position objects beneath the flexible mat 12 so as to impart contours to the flexible mat increasing a difficultly of the game. Such objects may include hemi-spherical bowls, rectangular objects, or any other shape so as to increase difficultly of the game.

As to a further discussion of the manner of usage and operation of the present invention, the same should be apparent from the above description. Accordingly, no further discussion relating to the manner of usage and operation will be provided.

With respect to the above description then, it is to be realized that optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A multiple compartment target putting game comprising:

an elongated flexible mat positionable upon a support surface, the mat being fabricated of a synthetic grass, the mat having spaced and parallel front and rear edges, the flexible mat is shaped so as to define a plurality of ball detents integrally directed thereinto extending in a linear array proximal to the front edge of the mat;

a target mounted to a rear edge of the flexible mat in a spaced relationship relative to the front edge, the target including a plurality of adjacent compartments which extend in a substantially parallel orientation relative to one another, each of the compartments dimensioned for receiving a single golf ball therein, each of the compartments includes numerical indicia printed thereon assigning a predetermined point value to each of the respective compartments, the target comprises an elongated top wall extending in a substantially spaced and parallel orientation relative to the rear edge of the flexible mat; spaced and parallel end walls projecting substantially orthogonally between the flexible mat and opposed transverse end edges of the top wall to support the top wall in a spaced and parallel orientation relative to the flexible mat; a plurality of dividing walls extending substantially orthogonally between the flexible mat and the top wall, the dividing walls being spaced an equal distance apart and oriented so as to extend parallel to one another so as to define a plurality of compartments of the target, the target further comprises a plurality of triangular guide plates having planar side surfaces, each guide plate projecting from an individual one of the dividing walls and extending onto the elongated flexible mat such that a pair of the triangular guide plates resides on opposed sides of each of the compartments, the target further comprises a plurality of retention ramps each extending between the spaced guide plates on opposed sides of an individual one of the compartments, the numerical indicia is of a first value proximal to the end walls of the target, and increases in equal incremental steps to a second value proximal to a center of the target, wherein the second value is substantially greater than the first value.

* * * * *